US010792699B2

(12) United States Patent
Yoneoka et al.

(10) Patent No.: US 10,792,699 B2
(45) Date of Patent: Oct. 6, 2020

(54) CURTAIN COATING DEVICE AND CURTAIN COATING METHOD

(71) Applicant: RICOH COMPANY, LTD., Tokyo (JP)

(72) Inventors: Takashi Yoneoka, Kanagawa (JP); Yasuhide Takashita, Shizuoka (JP); Shuji Hanai, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/921,855

(22) Filed: Mar. 15, 2018

(65) Prior Publication Data

US 2018/0264510 A1 Sep. 20, 2018

(30) Foreign Application Priority Data

Mar. 17, 2017 (JP) ..... 2017-053408
Feb. 26, 2018 (JP) ..... 2018-032457

(51) Int. Cl.
*B05C 5/00* (2006.01)
*B05C 17/02* (2006.01)
(Continued)

(52) U.S. Cl.
CPC ..... *B05C 17/0242* (2013.01); *B05C 5/004* (2013.01); *B05C 5/005* (2013.01);
(Continued)

(58) Field of Classification Search
USPC ..... 118/325, 300, DIG. 4, 410, 420, 324
See application file for complete search history.

(56) References Cited

U.S. PATENT DOCUMENTS 4,559,896 A 12/1985 Bossard et al.
4,647,482 A 3/1987 Degrauwe et al.
(Continued)

FOREIGN PATENT DOCUMENTS

CN 202175889 U 3/2012
JP 2002-086040 3/2002
JP 2008-221102 9/2008

OTHER PUBLICATIONS

Extended European Search Report dated Jul. 18, 2018 in Patent Application No. 18161822.4.
(Continued)

*Primary Examiner* — Yewebdar T Tadesse
(74) *Attorney, Agent, or Firm* — Xsensus LLP

(57) ABSTRACT

A curtain coating device includes a curtain coating member, a conveyance unit, a separation member, and a base material supporting member. The curtain coating member creates a curtain-like film of coating liquid and makes the curtain-like film flow down. The conveyance unit conveys a base material to which the curtain-like film is to be applied. The separation member includes a receiving portion inclined downward from inside to outside in a width direction of the curtain-like film, and separates an end portion of the curtain-like film having flowed down by receiving the end portion with the receiving portion above the base material. The base material supporting member is disposed inside in the width direction of the curtain-like film than the receiving portion of the separation member, and supports the base material on an upper side flat portion while the base material is being conveyed.

8 Claims, 8 Drawing Sheets

(51) Int. Cl.

| | |
|---|---|
| ***B05C 11/02*** | (2006.01) |
| ***B05D 1/30*** | (2006.01) |
| *B05C 5/02* | (2006.01) |

(52) U.S. Cl.
CPC ..... *B05C 5/008* (2013.01); *B05C 11/025* (2013.01); *B05D 1/305* (2013.01); *B05C 5/0266* (2013.01)

(56) References Cited

U.S. PATENT DOCUMENTS

| | | | | |
|---|---|---|---|---|
| 5,044,307 | A | 9/1991 | Takahashi et al. | |
| 5,368,643 | A | 11/1994 | Kuster | |
| 5,725,910 | A * | 3/1998 | Devine ..... | B05C 5/005 118/324 |
| 2008/0226828 | A1 | 9/2008 | Shimizu et al. | |
| 2009/0130323 | A1 | 5/2009 | Elsner | |
| 2011/0179998 | A1 | 7/2011 | Shimizu et al. | |

OTHER PUBLICATIONS

Office Action dated May 11, 2020, issued in corresponding Chinese Patent Application No. 201810212723.6, with English Translation, 18 pages.

* cited by examiner

CURTAIN COATING DEVICE AND CURTAIN COATING METHOD

CROSS-REFERENCE TO RELATED APPLICATIONS

The present application claims priority under 35 U.S.C. § 119 to Japanese Patent Application No. 2017-053408, filed on Mar. 17, 2017 and Japanese Patent Application No. 2018-032457, filed on Feb. 26, 2018. The contents of which are incorporated herein by reference in their entirety.

BACKGROUND OF THE INVENTION

1. Field of the Invention

The present invention relates to a curtain coating device and a curtain coating method.

2. Description of the Related Art

A curtain coating method is one of methods for forming a coating film on the surface of a sheet-like base material such as a sheet of paper and a piece of film. For example, some of curtain coating devices used in the curtain coating method include a mechanism that folds a sheet by a guide and that collects a coating liquid of both end portions of a curtain by providing a groove as disclosed in Japanese Unexamined Patent Application Publication No. 2002-86040. Such mechanism is introduced to form an uncoated portion on both ends of the sheet.

A slitter is used to remove the uncoated portion in the succeeding process. In general, the uncoated portion is slit by taking into account variation in the width of the uncoated portion and setting a larger width than that of a target uncoated portion so that an uncoated area does not remain after the uncoated portion is slit.

However, in view of improving productivity, there has been a demand to reduce the area to be removed as much as possible and to utilize the coated portion as much as possible.

SUMMARY OF THE INVENTION

According to one aspect of the present invention, a curtain coating device includes a curtain coating member, a conveyance unit, a separation member, and a base material supporting member. The curtain coating member creates a curtain-like film of coating liquid and makes the curtain-like film flow down. The conveyance unit conveys a base material to which the curtain-like film is to be applied. The separation member includes a receiving portion inclined downward from inside to outside in a width direction of the curtain-like film, and separates an end portion of the curtain-like film having flowed down by receiving the end portion with the receiving portion above the base material. The base material supporting member is disposed inside in the width direction of the curtain-like film than the receiving portion of the separation member, and supports the base material on an upper side flat portion while the base material is being conveyed.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1A:
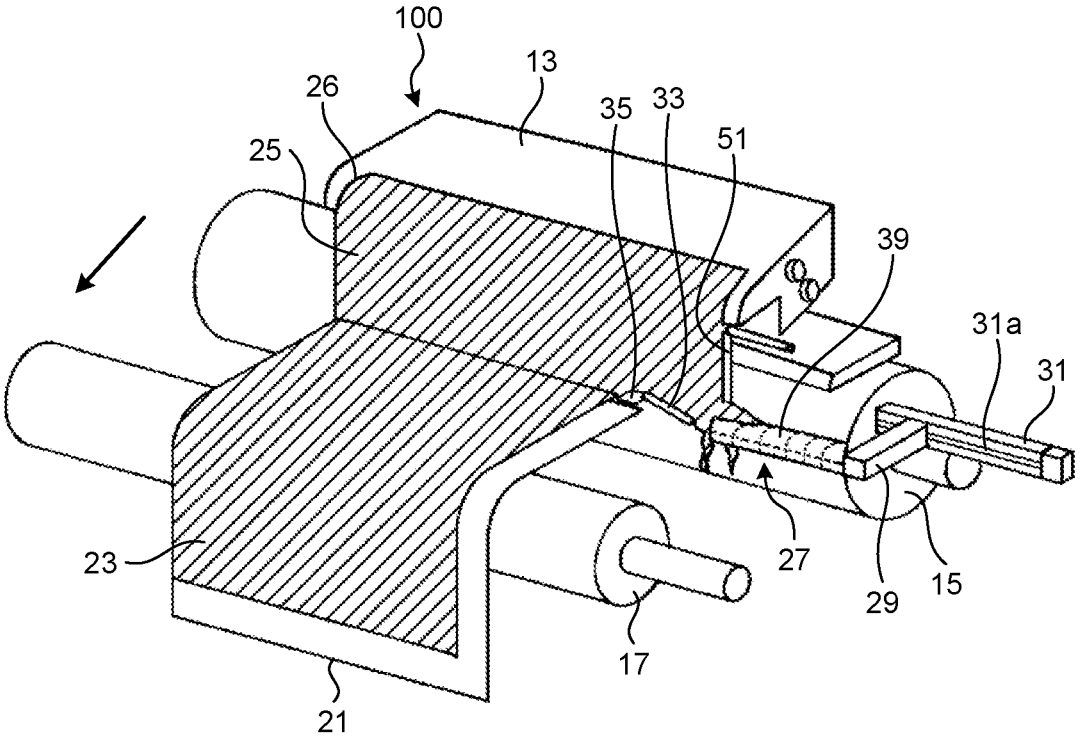
FIG. 1A and FIG. 1B are each a schematic view of one mode of a curtain coating device according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

The inventors of the present invention have found problems that in the curtain coating device including the mechanism as described above, an end portion of a bent sheet flaps when the sheet is passing below the groove, and due to the flapping, variation occurs in the width of the uncoated area. The inventors and the like of the present invention have also found that by reducing the variation in the width of the uncoated area, it is possible to minimize the cutting-off amount of the uncoated portion in the succeeding process, and to reduce the loss of the base material.

An object of an embodiment is to provide a curtain coating device capable of preventing the base material (sheet) from flapping, and keeping the uncoated width of the end portion in the base material width direction uniform.

An embodiment of the present invention will be described in detail below with reference to the drawings.

Figure 1B:
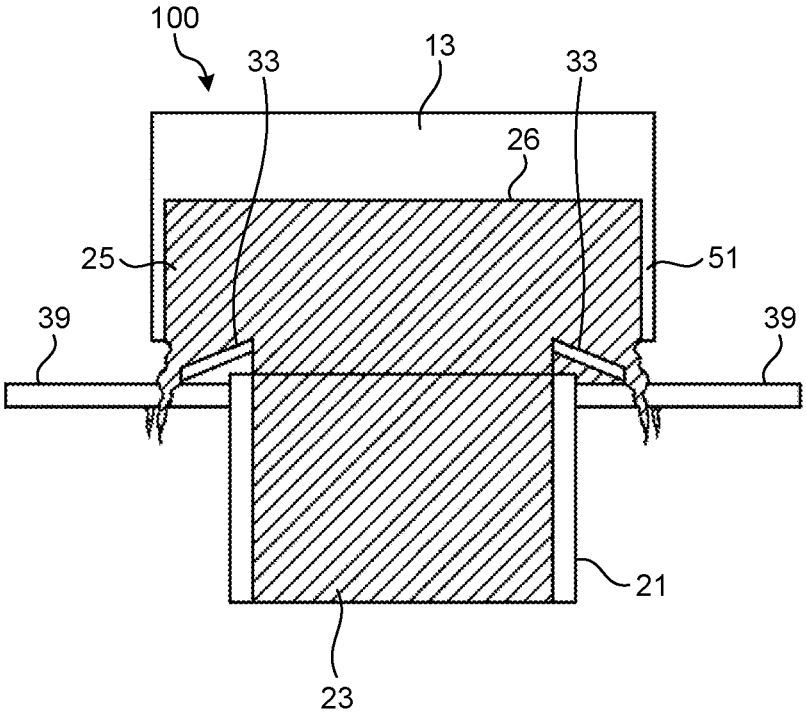

FIG. 1A and FIG. 1B are each a schematic view of one mode of a curtain coating device 100 according to an embodiment. FIG. 1A is a schematic perspective view of the curtain coating device 100, and FIG. 1B is a front view of the curtain coating device 100. In FIG. 1B, a first conveyance roller 15, a second conveyance roller 17, and the like are not illustrated. It is to be noted that the curtain coating device of the present invention is not limited to the one illustrated in FIG. 1A and FIG. 1B, and the curtain coating device may be suitably changed without departing from the spirit of the present invention.

The curtain coating device 100 includes a curtain coating member 13, the first conveyance roller 15, and the second conveyance roller 17. The first conveyance roller 15 is disposed below the curtain coating member 13, and conveys a base material 21 serving as a member to be coated. The second conveyance roller 17 is disposed at the downstream side of the conveying direction than the first conveyance roller 15, and conveys the base material 21 in the lower direction. In this example, the first conveyance roller 15 serving as a first roller and the second conveyance roller 17 serving as a second roller serve as a conveyance unit of the base material 21 to which a curtain-like film is to be applied.

Moreover, the curtain coating device 100 includes the curtain coating member 13 that forms a coating film 23 by dropping a curtain-like film 25 on the base material 21 between the first conveyance roller 15 and the second conveyance roller 17, and includes a coating width control member 27 that controls the coating width of the curtain-like film 25.

In the curtain coating device 100, for example, as illustrated in FIG. 1A and FIG. 1B, the coating width can be changed to a desired width, by providing a connection arm 29 and a guide member 31 that guides the connection arm 29 and moves the coating width control member 27 in the width direction of the base material 21. However, in a case where the coating width is fixed and thus there is no need to change the coating width, the guide member 31 is not necessarily required.

The curtain coating member 13 includes an ejection port 26 that ejects a coating liquid (coating solution) 103 (see FIG. 2) in a curtain shape. For example, the curtain coating member 13 is a slide-type curtain coating member and a slot-type curtain coating member. In the present invention, either one of the curtain coating members may be used.

The curtain coating device 100 includes an edge guide 51 capable of keeping the liquid film in a curtain shape.

Figure 2:
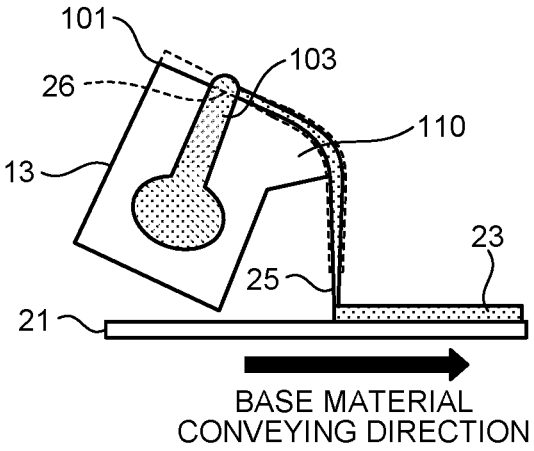
FIG. 2 is a side cross-sectional schematic view of a slide-type curtain coating member.

FIG. 2 illustrates one mode of a slide-type curtain coating member. FIG. 2 is a side cross-sectional schematic view of the curtain coating member 13.

The curtain coating member 13 includes a slide die 101, the coating liquid 103 held in the slide die, and the slit-shaped ejection port 26 for ejecting the coating liquid 103. The coating liquid 103 ejected from the ejection port 26 flows along on a slide die main body 110, flows down onto the base material 21 in the form of the curtain-like film 25, thereby forming the coating film 23 on the base material 21.

The curtain coating device 100 illustrated in FIG. 1A and FIG. 1B is a curtain coating device in overboard mode including a slide-type curtain coating member. The curtain-like film 25 ejected from the ejection port 26 of the curtain coating member 13 is controlled to a desired width by the coating width control member 27, and is then applied on the conveyed base material 21. The coating width control member 27 adjusts the coating width by using a separation member that separates an end portion film not to be used for coating the base material 21 in the ejected curtain-like film 25. A liquid receiving member 43 (see FIG. 8) provided below the coating width control member 27 collects the coating liquid 103 that has formed the separated end portion film.

The coating width control member 27 may be disposed on both ends of the base material 21 in the width direction, or may be disposed on one of the ends of the base material 21 in the width direction. The coating width control member 27 and the like are not illustrated in the left side of FIG. 1A and FIG. 1B.

Next, details of the guide member will be described. One end of the guide member 31 that extends in the width direction of the base material 21 is supported by a casing of the curtain coating device 100. The guide member 31 includes a guide groove 31*a* into which one end of the connection arm 29 that extends in the base material conveying direction is to be inserted. The other end of the connection arm 29 is fixed to the coating width control member 27. Thus, the coating width control member 27 and the connection arm 29 are guided along the guide member 31 that extends in the width direction of the base material 21 in an integral manner, and the width of the curtain-like film 25 is changeable by moving the coating width control member 27. However, the configuration of the guide member is not limited thereto, and if there is no need to change the coating width or the like, the guide member is not necessarily required.

In the following, one example of the coating width control member 27 will be described. It is to be noted that the coating width control member in the present invention is not limited to the one illustrated in FIG. 3A to FIG. 3F, and the coating width control member may be suitably changed without departing from the spirit of the present invention.

Figure 3A:
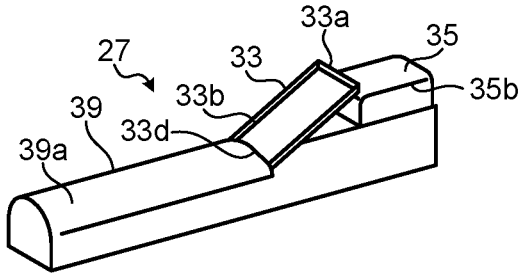
FIG. 3A to FIG. 3F are each a schematic view of a coating width control member.
Figure 3B:
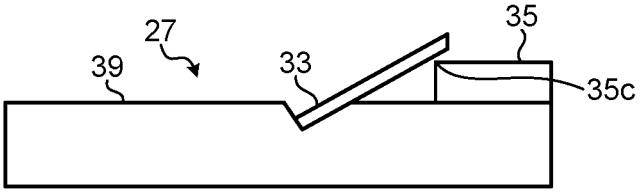
Figure 3C:
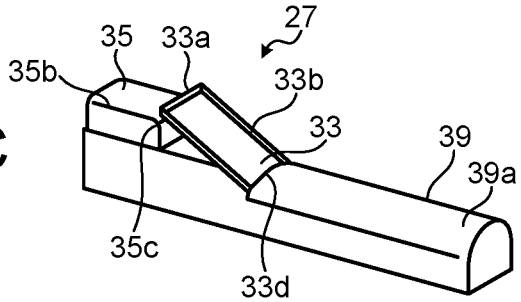
Figure 3D:
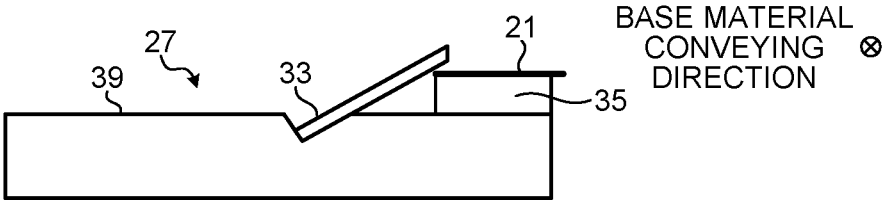

FIG. 3A to FIG. 3F are each a schematic view of a coating width control member. FIG. 4 is a schematic perspective view of a separation member. FIG. 3A is a perspective view of the coating width control member 27, when the coating width control member 27 is viewed from the first conveyance roller 15 side in the base material conveying direction. FIG. 3B is a front view of the coating width control member 27. FIG. 3C is a perspective view of the coating width control member 27, when the coating width control member 27 is viewed from the second conveyance roller 17 side in a direction opposite from the base material conveying direction. FIG. 3D is similar to FIG. 3B, but illustrates the base material 21 to be conveyed from the front of the paper surface vertical direction toward the rear of the paper surface vertical direction.

As illustrated in FIG. 3A to FIG. 3F, the coating width control member 27 includes a separation member 33 and a base material supporting member 35, and is capable of moving in the width direction of the curtain-like film 25. The separation member 33 and the base material supporting member 35 need not be integrally formed. However, for example, the coating width can be easily changed when the positional relation between the separation member 33 and the base material supporting member 35 is fixed (in other words, integrally formed) using a fixing tool such as a bolt.

Separation Member

As illustrated in FIG. 1A and FIG. 1B, the separation member 33 is capable of separating a portion of the curtain-like film 25 that is created and made to flow down by the curtain coating member 13 and that is not to be used for coating the base material 21, from a portion that is to be used for coating the base material 21. As illustrated in FIG. 4, the separation member 33 includes a receiving portion 33*c* that receives the coating liquid 103, a separation wall 33*a* that is disposed so as to surround the receiving portion 33*c* and that separates the curtain-like film 25, sidewalls 33*b* that guide the separated coating liquid 103 toward the downstream side, and a downstream tip end 33*d*.

Width h of the separation member 33 that corresponds to the distance between the sidewalls 33*b* is not particularly limited, and may be suitably selected according to the object. Length l of the separation member 33 is also not particularly limited, and may be suitably selected according to the object.

The thickness of the separation wall 33*a* of the separation member 33 is not particularly limited, but it is preferable that the separation wall 33*a* is formed in a flat surface shape of 0.1 mm to 2 mm. When the thickness of the separation wall 33*a* is within a range from 0.1 mm to 2 mm, it is possible to prevent the disturbance of flux that may occur due to contact between the coating liquid 103 that has flowed down onto the separation wall 33*a* and the separation wall 33*a*, and reduce variation in the thickness of the coating film end portion, while ensuring the strength of the separation wall.

It is also preferable that the separation wall 33*a* is fixed to the receiving portion 33*c* such that the surface direction of the separation wall 33*a* is orthogonal to the surface direction of the curtain-like film 25 that has flowed down from the curtain coating member 13. Consequently, it is possible to minimize the contact area between the coating liquid 103 that has flowed down onto the separation wall 33*a* and the separation wall 33*a*. Moreover, it is preferable that the separation member 33 is disposed on the curtain coating device 100 such that the surface direction of the separation wall 33*a* is in parallel with the conveying direction of the base material, during coating. Consequently, even if the curtain-like film 25 is deviated in the conveying direction, the coating film end portion does not move in a zigzag manner and is formed in a shape excellent in linearity.

The height of the separation wall 33*a* is preferably within a range from 1 mm to 50 mm. However, it is not limited thereto. When the height of the separation wall 33*a* is less than 1 mm, the coating liquid 103 that has once flowed into the receiving portion 33*c* of the separation member 33 tends to overflow toward the coating side. Moreover, when the height of the separation wall 33*a* exceeds 50 mm, the flowing speed of the curtain-like film 25 that flows down while coming into contact with the coating-side sidewall of the separation wall 33*a* slows down. Thus, the end portion of the coating film 23 that is to be formed on the base material 21 tends to become thick, thereby lowering the flatness of the coating film 23.

The height of the sidewall 33*b* is not particularly limited, and may be suitably selected according to the object.

The coating liquid 103 that flows down from the separation member 33 and the coating liquid 103 that falls down onto a coating liquid flowing member 39 flow down along the coating liquid flowing member 39.

Base Material Supporting Member

Figure 5A:
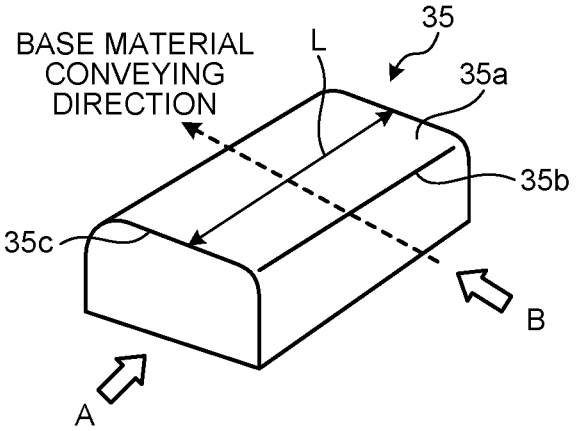
FIG. 5A to FIG. 5C are each an enlarged schematic view of a base material supporting member.
Figure 5B:
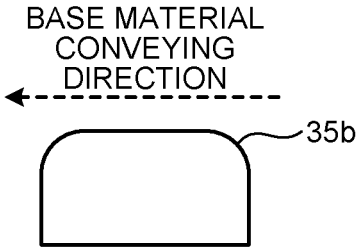
Figure 5C:
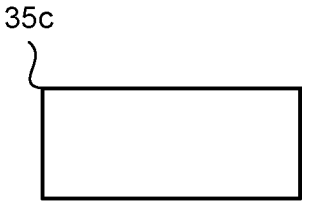

FIG. 5A to FIG. 5C are each an enlarged schematic view of a base material supporting member. FIG. 5A is a perspective schematic view of the base material supporting member 35. FIG. 5B is a fragmentary view taken in the direction of an arrow A in FIG. 5A. FIG. 5C is a fragmentary view taken in the direction of an arrow B in FIG. 5A. In FIG. 5A and FIG. 5B, the dotted arrow is the conveying direction of a base material.

As illustrated in FIG. 5A, the base material supporting member 35 is a member including, as an upper surface, an upper side flat portion 35*a* that is parallel to the surface direction of the traveling base material 21. The base material supporting member 35 prevents the traveling base material 21 from fluttering, by giving a suitable tension while supporting the rear surface of the base material 21 to which the coating liquid 103 is to be applied, at the position where the curtain-like film 25 falls down from the curtain coating member 13.

To ensure such function, the length L of the base material supporting member 35 in the width direction of the base material 21 is preferably within a range from 30 mm to 300 mm. However, it is not limited thereto. When the length L is within the range from 30 mm to 300 mm, it is possible to prevent the base material 21 to be supported on the upper side flat portion 35*a* of the base material supporting member 35 from fluttering, while ensuring the rigidity of the coating width control member 27 that is to be cantilevered by the casing as illustrated in FIG. 1A and FIG. 1B, at the base material supporting member 35 side. When the length L of the base material supporting member 35 is less than 30 mm, the upper side flat portion 35*a* cannot sufficiently support the base material 21. Thus, it may not be possible to sufficiently prevent the base material 21 from fluttering. Moreover, when the length L is exceeds 300 mm, the base material supporting member 35 tends to bend easily.

As illustrated in FIG. 5B, it is preferable that an edge 35*b* that extends in parallel along the width direction of the base material 21 and that is placed at the upstream side in the base material conveying direction has a round shape. By forming the edge 35*b* in such a shape, it is possible to reduce stress that the base material 21 receives from the edge 35*b* during conveyance, and prevent the base material 21 from cracking.

Figure 7A:
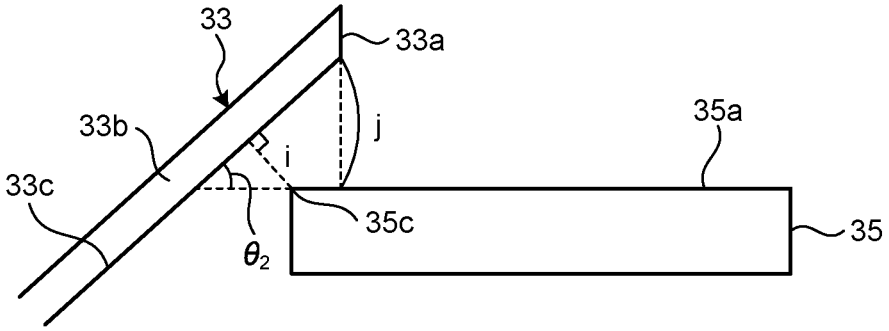
FIG. 7A and FIG. 7B are each a schematic view illustrating a positional relation between the separation member and the base material supporting member.
Figure 7B:
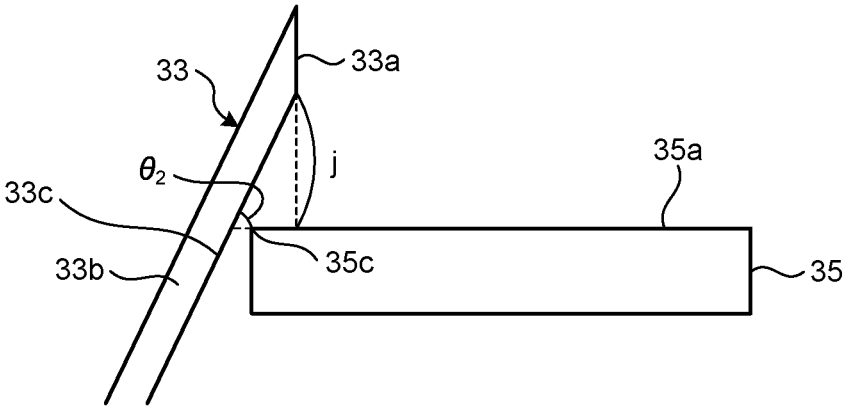

In contrast, as illustrated in FIG. 5C, it is preferable that an edge 35*c* that extends in parallel along the base material conveying direction and that is facing the separation member 33 has an angular shape. A narrow space between the edge 35*c* and the separation member 33 is a space where the base material 21 is to be conveyed (FIG. 7A and FIG. 7B). By reducing the size of this narrow space with the angular edge 35*c*, it is possible to prevent a foreign matter and the like from being caught in the narrow space.

In FIG. 3D, the base material supporting member 35 is fixed to the upper portion of the coating liquid flowing member 39 by a bolt. However, the base material supporting member 35 may also be fixed using another fixing member such as an adhesive agent instead of the bolt.

Figure 3E:
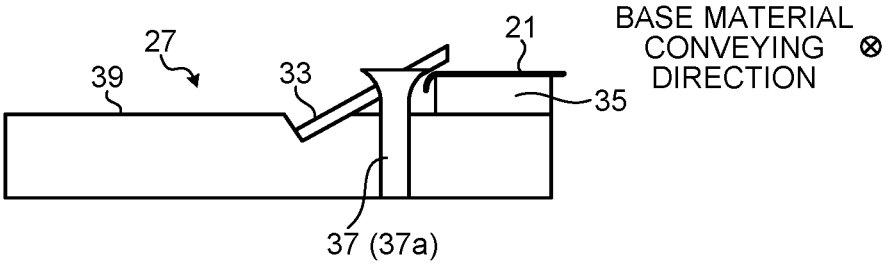
Figure 4:
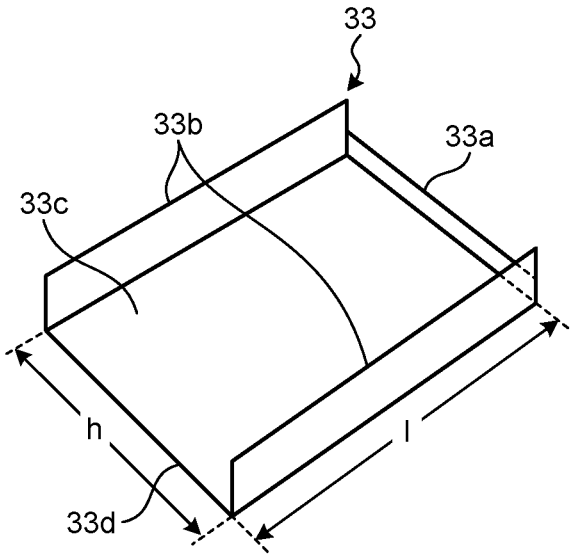
FIG. 4 is a schematic perspective view of a separation member.

As illustrated in FIG. 3E, the coating width control member 27 may also include a bending member 37 (37*a*). The surface of the bending member 37 (37*a*) illustrated in FIG. 3E that comes into contact with the base material 21 is formed in a shape having a curvature. The bending member 37 (37*a*) is mounted so that the bending member 37 (37*a*) intersects with the surface of the base material 21 at an acute angle, and the end portion of the base material 21 is bent downward at an obtuse angle. As illustrated in FIG. 3E, the end portion of the base material 21 bends downward by coming into contact with the bending member 37 (37*a*). The base material 21 passes a space between the separation member 33 and the base material supporting member 35 that is disposed at the downstream side in the conveying direction than the bending member 37 (37*a*) while maintaining the bending state.

As long as the end portion of the bending member 37 (37*a*) for bending the base material 21 has a curvature, the bending member 37 (37*a*) is not limited to the one disclosed in the drawing of the present application, and a configuration such as a guide disclosed in Japanese Unexamined Patent Application Publication No. 2002-86040 may also be used.

Figure 3F:
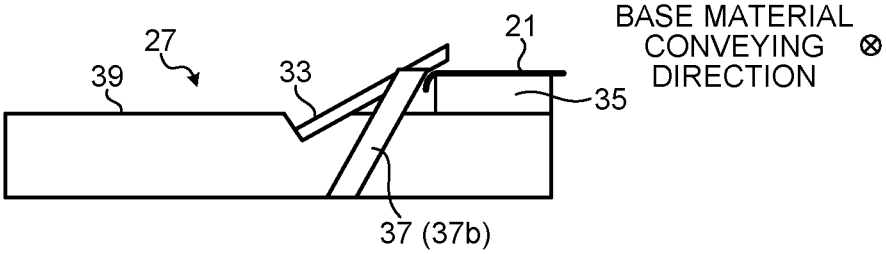

Moreover, as illustrated in FIG. 3F, the coating width control member 27 may include a bending member 37 (37*b*).

The bending member 37 (37*b*) illustrated in FIG. 3F is a rod-shaped member, and is mounted so that the bending member 37 (37*b*) is inclined toward the base material 21 side. Moreover, the bending member 37 (37*b*) is mounted so that the bending member 37 (37*b*) intersects with the surface of the base material 21 at an acute angle, and the end portion of the base material 21 is bent downward at an obtuse angle. The end portion of the base material 21 bends downward as illustrated in FIG. 3F, by coming into contact with the bending member 37 (37*b*). The base material 21 passes a space between the separation member 33 and the base material supporting member 35 that is disposed at the downstream side in the conveying direction than the bending member 37 (37*b*) while maintaining the bending state.

Coating Liquid Flowing Member

Figure 6A:
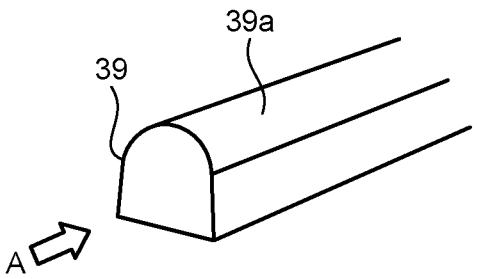
FIG. 6A to FIG. 6C are each an enlarged partial schematic view of a coating liquid flowing member.
Figure 6B:
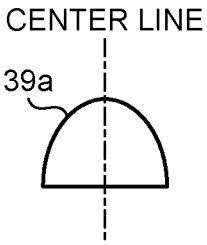
Figure 6C:
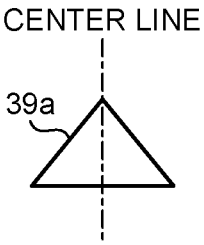

FIG. 6A to FIG. 6C are each an enlarged partial schematic view of a coating liquid flowing member. FIG. 6A is a schematic perspective view of the coating liquid flowing member. FIG. 6B is a fragmentary view taken in the direction of an arrow A in FIG. 6A. FIG. 6C is another example of the coating liquid flowing member.

The coating liquid flowing member 39 is coupled to the separation member 33 such that the coating liquid separated by the separation member 33 flows along. It is preferable that a top surface 39*a* of the coating liquid flowing member 39 on which the curtain-like film 25 falls down is formed in a shape having a curvature. As illustrated in FIG. 6B, the top surface 39*a* of the coating liquid flowing member 39 is curved in a convex shape, and is formed in a symmetric shape relative to the center line in the vertical direction. However, the shape of the top surface 39*a* is not limited to the shape described above, and for example, as illustrated in FIG. 6C, may be formed so that the cross-sectional shape becomes triangular in shape. Such a symmetric shape allows the falling curtain-like film 25 to flow down smoothly and uniformly toward both sides of the center line. Consequently, it is possible to collect the curtain-like film 25 separated by the separation member 33 while suppressing bubbles from generating in the collected liquid.

As illustrated in FIG. 1A and FIG. 1B, the coating liquid flowing member 39 is disposed below the separation member 33 such that the separated liquid that is separated by the separation member 33 flows onto the top surface 39*a* of the coating liquid flowing member 39.

Next, arrangements of the members are described with reference to the drawings.

The separation wall 33*a* of the separation member 33 is disposed such that the surface direction of the separation wall 33*a* is in parallel with the conveying direction of the base material 21. As illustrated in FIG. 3C, the separation member 33 is inclined downward toward the outside direction of the curtain-like film 25 from above the edge 35*c* of the base material supporting member 35 that is placed at the end portion side of the base material 21 in the width direction than the separation member 33.

FIG. 7A and FIG. 7B are each a schematic view illustrating a positional relation between the separation member 33 and the base material supporting member 35.

In the embodiment of FIG. 7A, the separation member 33 is disposed so as to have an inclination angle $\theta_2$ relative to the upper side flat portion 35*a* of the base material supporting member 35. The inclination angle $\theta_2$ is not particularly limited, but it is preferable that the inclination angle $\theta_2$ is within a range from 30 degrees to 60 degrees. When the inclination angle $\theta_2$ is less than 30 degrees, the gradient of the separation member 33 becomes gentle, and the coating liquid 103 is prevented from easily flowing down on the separation member 33. In the example of FIG. 7B, the inclination angle $\theta_2$ is larger than 60 degrees. When the inclination angle $\theta_2$ is larger than 60 degrees, distance between the separation wall 33*a* of the separation member 33 and the base material 21 is increased. Thus, distance j that is distance of the curtain-like film 25 separated by the separation member 33 reaching the upper side flat portion 35*a* will be increased. Even if the inclination angle $\theta_2$ is within a range from 30 degrees to 60 degrees, it is preferable that the base material supporting member 35 and the separation member 33 are disposed so that the distance j between the upper side flat portion 35*a* and the lower edge of the receiving portion 33*c* of the separation member 33 becomes less than 3 mm.

By disposing the base material supporting member 35 and the separation member 33 so that the distance j between the separation wall 33*a* and the upper side flat portion 35*a*, and the inclination angle $\theta_2$ satisfy the conditions as described above, it is possible to prevent the coating film end portion from being locally thickened due to the contraction of the edge portion of the curtain-like film 25.

Distance between the receiving portion 33*c* of the separation member 33 and the edge 35*c* of the base material supporting member 35 will now be described with reference to FIG. 3D and FIG. 7A. Minimum distance i between the receiving portion 33*c* and the edge 35*c* that is the upper end portion of the base material supporting member 35 is not particularly limited. However, it is preferable that the minimum distance i is length obtained by adding 0.1 mm to 20 mm to the thickness of the base material 21. When the minimum distance i is less than 0.1 mm, there is a possibility of cracking the base material, because a foreign matter may be caught between the base material 21 and the member.

Figure 8:
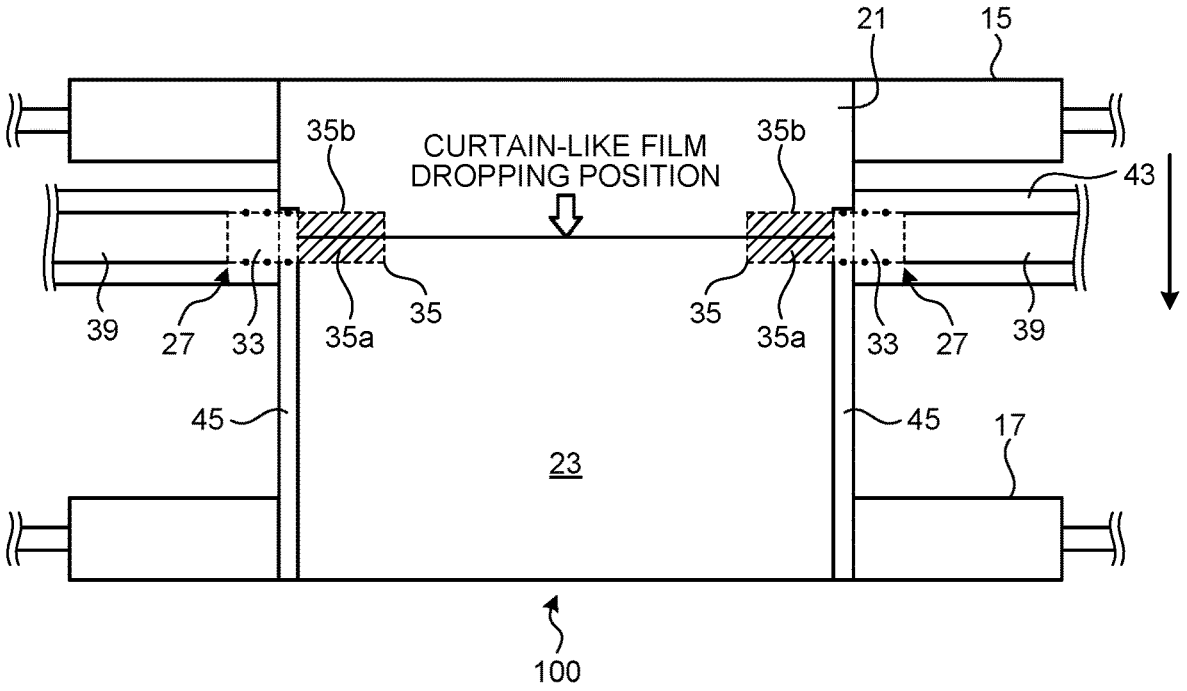
FIG. 8 is a partial schematic plan view of a curtain coating device including the coating width control member.

FIG. 8 is a partial schematic plan view of the curtain coating device 100 including the coating width control member 27.

In FIG. 8, the curtain coating member 13, the curtain-like film 25, and the like are not illustrated. The base material supporting member 35 of the coating width control member 27 is disposed below the base material 21 and inside of the end portion of the base material 21. The upper side flat portion 35*a* of the base material supporting member 35 is disposed so that the upper side flat portion 35*a* is in parallel with the surface of the base material 21 that travels in the arrow direction (base material conveying direction). The edge 35*b* of the base material supporting member 35 is disposed so as to be orthogonal to the base material conveying direction.

The base material 21 is conveyed in a state so that tension is applied to the base material 21 by the first conveyance roller 15 and the second conveyance roller 17. It is preferable that the upper side flat portion 35*a* of the base material supporting member 35 is placed at a higher position by 0 mm to 10 mm than the height position of the base material 21, when the base material 21 is stretched between the first conveyance roller 15 and the second conveyance roller 17, while the base material supporting member 35 is not installed. By doing so, it is possible to apply tension to the base material 21 furthermore, and prevent the end portion of the base material 21 from fluttering during conveyance.

The separation member 33 of the coating width control member 27 is disposed such that the upper end of the separation member 33 is overlapped with the inner end of the base material supporting member 35 when viewed from above. An area of the end portion of the base material 21 that has passed below the separation member 33 will not be coated with the coating liquid 103, and becomes an uncoated portion 45.

When viewed from above, the base material supporting member 35, the separation member 33, and the coating liquid flowing member 39 are linearly arranged in the base material width direction.

The liquid receiving member 43 for receiving the flowed coating liquid may be disposed below the coating liquid flowing member 39. When the liquid receiving member 43 is to be provided, it is preferable that the width of the liquid receiving member 43 is larger than the width of the coating liquid flowing member 39 such that the flowed coating liquid 103 can be collected without fail. The collected liquid collected by the liquid receiving member 43 may be suitably reused as the coating liquid 103.

Figure 9:
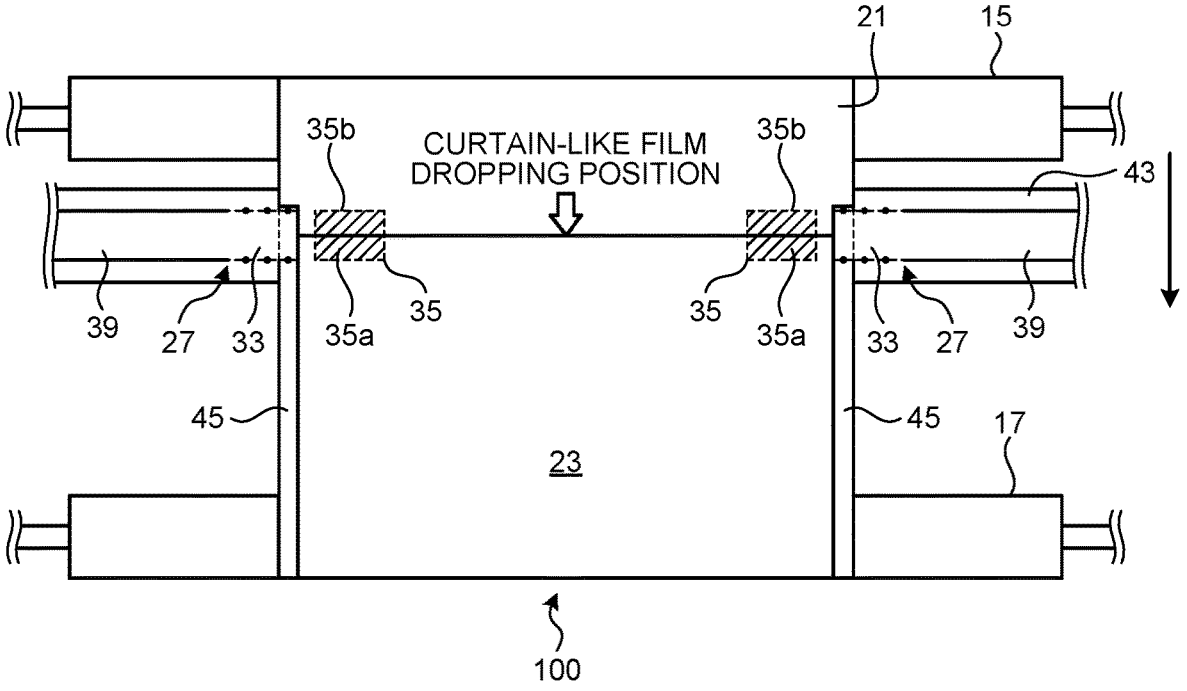
FIG. 9 is a partial schematic plane view illustrating a modification example of the curtain coating device including the coating width control member.
Figure 10:
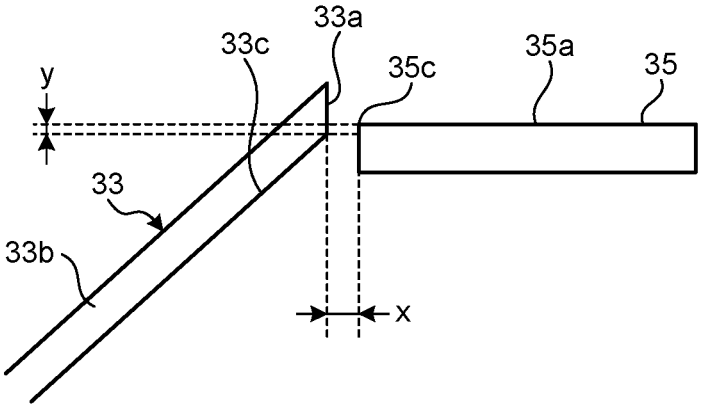
FIG. 10 is a schematic view illustrating a modification example of the positional relation between the separation member and the base material supporting member.

FIG. 9 is a partial schematic plane view illustrating a modification example of the curtain coating device 100 including the coating width control member 27, and FIG. 10 is a schematic view illustrating a modification example of the positional relation between the separation member 33 and the base material supporting member 35. As illustrated in FIG. 9, the separation member 33 and the base material supporting member 35 may be disposed so as not to overlap with each other when viewed from above. In this case, as illustrated in FIG. 10, a distance x between the separation member 33 and the base material supporting member 35 is preferably within a range from 2 mm to 10 mm, more preferably within a range from 3 mm to 6 mm. A distance y between the upper side flat portion 35*a* and the lower edge of the receiving portion 33*c* is preferably within a range from 1 mm to 5 mm. In such a positional relation, even if the dregs of the coating liquid are generated at the tip of the separation member 33, the base material 21 being bent comes in contact with the liquid dregs. As a result, the liquid dregs are not grown any more, and therefore, the variation in the width of the uncoated portion 45 can be reduced.

Next, a curtain coating method according to the embodiment of the present invention will be described with reference to FIGS. 1A and 1B, and FIG. 8.

As illustrated in FIG. 1A and FIG. 1B, the curtain-like film 25 flows down from the curtain coating member 13. The separation member 33 provided in the coating width control member 27 separates a part of the ejected curtain-like film 25. The part of the ejected curtain-like film 25 is then collected (first curtain-like film: right side of the separation wall 33*a* of the separation member 33). A portion of the curtain-like film 25 that is not collected by the separation member 33 and that flows down in a curtain-like state (second curtain-like film: left side of the separation wall 33*a* of the separation member 33) flows down onto the conveyed base material 21, thereby forming the coating film 23 on the base material 21.

As illustrated in FIG. 8, the base material 21 is conveyed in the base material conveying direction (from the first conveyance roller 15 toward the second conveyance roller 17) indicated by the arrow, by the first conveyance roller 15 and the second conveyance roller 17. The base material 21 is conveyed toward the downstream side of the base material conveying direction while both end portions of the base material 21 in the width direction pass a space between the edge 35*c* of the base material supporting member 35 and the separation member 33 (FIG. 7A and FIG. 7B).

The base material 21 passes below the separation member 33 and is conveyed in the downstream direction, while tension is applied by coming into contact with the base material supporting member 35 provided in the coating width control member 27. An area of the base material 21 that has passed below the separation member 33 becomes the uncoated portion 45 on which the coating film 23 is not formed.

A supporting member for supporting a base material such as a supporting roller need not be particularly provided at the center portion of the base material 21 in the width direction.

The base material 21 formed with the coating film 23 is further conveyed in the downstream direction by the second conveyance roller 17, and is dried by a drying unit disposed at the downstream side of the device.

Figure 11:
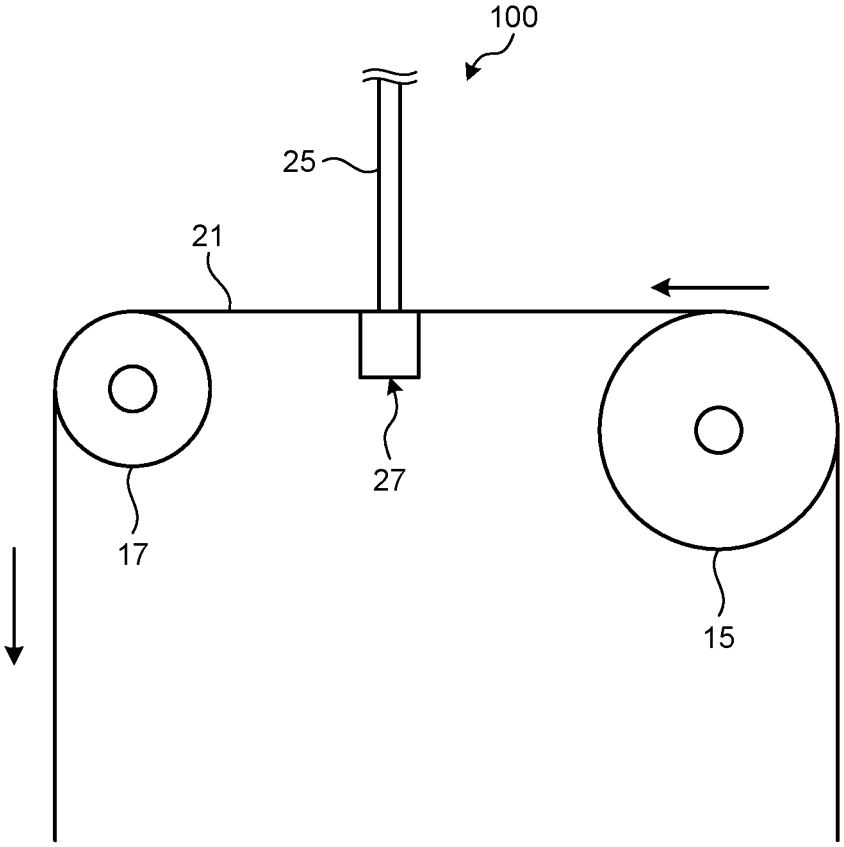
FIG. 11 is a schematic side view illustrating a side surface of the curtain coating device.

FIG. 11 is a schematic side view illustrating a side surface of the curtain coating device 100. In FIG. 11, the same members as those illustrated in FIG. 1A and FIG. 1B are not illustrated. As illustrated in FIG. 9, the base material 21 is conveyed by the first conveyance roller 15 and the second conveyance roller 17, and the coating liquid 103 is applied on the base material 21 at the position where the curtain-like film 25 falls down from the curtain coating member 13.

The material of the separation member 33, the base material supporting member 35, the bending members 37 (37*a* and 37*b*), and the coating liquid flowing member 39 may be suitably selected according to the object. For example, metals such as stainless steel, aluminum, and iron, or these types of metals applied with hard chromium plating, and resins such as polytetrafluoroethylene (Teflon (registered trademark)), polyethylene terephthalate (PET) resin, acrylonitrile-butadiene-styrene (ABS) resin, fiber-glass reinforced plastic (FRP), and nylon may be used.

Figure 12:
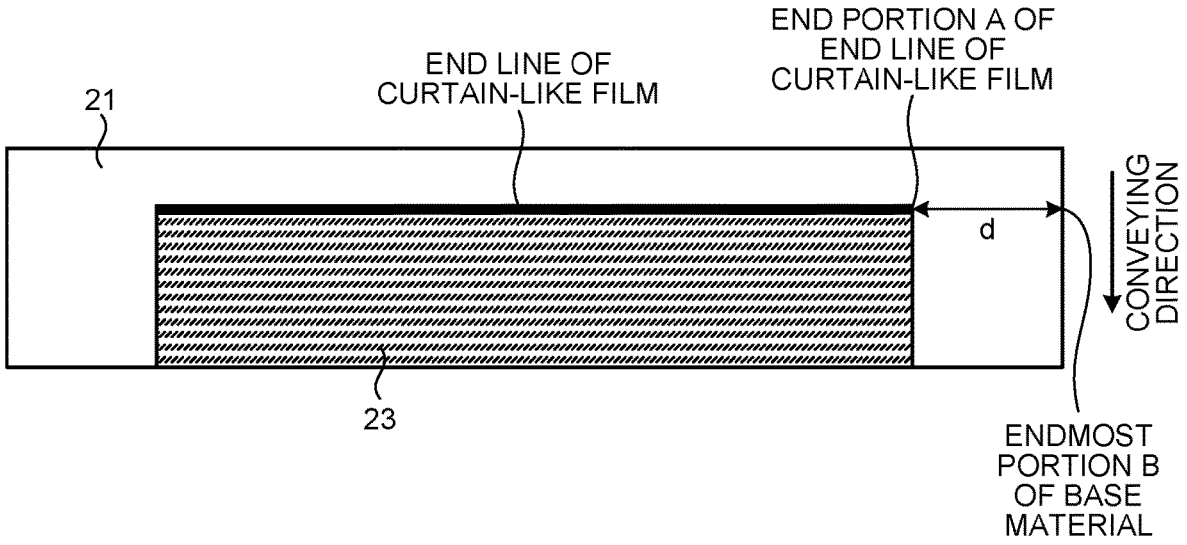
FIG. 12 is a diagram illustrating distance between an end portion of a part (end line) at which a curtain-like film reaches a base material and an endmost portion in the base material width direction along the extension of the end line.

FIG. 12 is a diagram illustrating distance d between an end portion A of a position (end line) at which the curtain-like film 25 reaches the base material 21 and an endmost portion B in the base material width direction along the extension of the end line. By using the curtain coating device 100 of the present invention as described above, it is possible to prevent the end portion of the base material 21 in the width direction from fluttering during conveyance. As a result, it is possible to keep the distance d between the end portion A (FIG. 12) of the position (end line) at which the curtain-like film 25 reaches the base material 21 and the endmost portion B in the base material width direction along the extension of the end line constant. When the distance d is constant, the width of the uncoated portion 45 is prevented from being varied. Consequently, a margin taking into account the variation in the width of the uncoated portion 45 can be minimized, when the uncoated portion 45 is to be cut off in the succeeding process. In other words, the usage rate of the coated area is greatly improved.

EXAMPLES

Hereinafter, examples of the present invention will be described.

First Example

The coating film 23 was formed on the base material 21 using the curtain coating device 100 of the present invention. Thereafter, variation in the width of the uncoated portion 45 of the coating film end portion was evaluated.

The coating conditions are as follows:

1) Base material: paper weighing 60 grams per square meter
2) Base material speed: 450 m/minute
3) Approximate amount of liquid adhesion: wet 30 g/m$^2$
4) Base material width: 1000 mm 5) Coating width: 990 mm (install the coating width control member such that 5 mm of the uncoated portion is formed on both ends of the base material)
6) Coating liquid: polyvinyl alcohol aqueous solution (20 wt %)
7) Coating liquid viscosity: 1000 mPa·s (value measured by a type B viscometer)
8) Separation member: included
9) Base material supporting member: included
10) Bending member: included Method for Evaluating Width Variation In the area of the coated base material as much as 1 meter in length in the base material traveling direction, a maximum value dmax and a minimum value dmin of the distance d between the endmost portion of the base material and the endmost portion of the coated portion was measured, and a difference Δd (=dmax−dmin) was calculated. Δd was calculated for 30 locations that do not overlap with each other. Next, an average value Δdave of the obtained 30 Δd was calculated.

The evaluation criteria for Δdave are as follows:

A: Variation in distance between the base material end portion and the coated end portion is extremely small (Δdave≤1.5 mm)

B: Variation in distance between the base material end portion and the coated end portion is small (1.5 mm<Δdave≤2.5 mm)

C: Variation in distance between the base material end portion and the coated end portion is large (2.5 mm<Δdave≤3.5 mm)

D: Variation in distance between the base material end portion and the coated end portion is extremely large (3.5 mm<Δdave)

Second Example

The coating conditions 6) to 9) in the first example were changed as follows, and the coating film 23 was formed on the base material 21 using the curtain coating device 100 of the present invention. Thereafter, variation in the width of the uncoated portion 45 of the coating film end portion was evaluated. The conditions 1 to 5 were the same as those in the first example.

6) Coating liquid: adhesive
7) Coating liquid viscosity: 2000 mPa·s (value measured by a type B viscometer)
8) Separation member: included
9) Base material supporting member: included
10) Bending member: included

Third Example

The coating film 23 was formed on the base material 21 using the curtain coating device 100 of the present invention. Thereafter, variation in the width of the uncoated portion 45 of the coating film end portion was evaluated.

The coating conditions are as follows:

1) Base material: paper weighing 60 grams per square meter
2) Base material speed: 450 m/minute
3) Approximate amount of liquid adhesion: wet 30 g/m$^2$
4) Base material width: 1000 mm
5) Coating width: 990 mm (install the coating width control member such that 5 mm of the uncoated portion is formed on both ends of the base material)
6) Coating liquid: polyvinyl alcohol aqueous solution (20 wt %)
7) Coating liquid viscosity: 1000 mPa·s (value measured by a type B viscometer)
8) Separation member: included
9) Base material supporting member: included
10) Bending member: not included

First Comparative Example

The coating conditions 6) to 9) in the first example were changed as follows, and the coating film was formed on the base material using a conventional curtain coating device to which the present invention is not applied. Thereafter, variation in the width of the uncoated portion of the coating film end portion was evaluated. The conditions 1 to 5 were the same as those in the first example.

6) Coating liquid: polyvinyl alcohol aqueous solution (20 wt %)
7) Coating liquid viscosity: 1000 mPa·s (value measured by a type B viscometer)
8) Separation member: not included
9) Base material supporting member: not included
10) Bending member: included

Second Comparative Example

The coating conditions 6) to 9) in the first example were changed as follows, and the coating film was formed on the base material using a conventional curtain coating device to which the present invention is not applied. Thereafter, variation in the width of the uncoated portion of the coating film end portion was evaluated. The conditions 1 to 5 were the same as those in the first example.

6) Coating liquid: adhesive
7) Coating liquid viscosity: 2000 mPa·s (value measured by a type B viscometer)
8) Separation member: not included
9) Base material supporting member: not included
10) Bending member: included

Third Comparative Example

The coating conditions 6) to 9) in the first example were changed as follows, and the coating film was formed on the base material using a conventional curtain coating device to which the present invention is not applied. Thereafter, variation in the width of the uncoated portion of the coating film end portion was evaluated. The conditions 1 to 5 were the same as those in the first example.

6) Coating liquid: polyvinyl alcohol aqueous solution (20 wt %)
7) Coating liquid viscosity: 1000 mPa·s (value measured by a type B viscometer)
8) Separation member: included
9) Base material supporting member: not included
10) Bending member: included

Fourth Comparative Example

The coating conditions 6) to 9) in the first example were changed as follows, and the coating film was formed on the base material using a conventional curtain coating device to which the present invention is not applied. Thereafter, variation in the width of the uncoated portion of the coating film end portion was evaluated. The conditions 1 to 5 were the same as those in the first example.

6) Coating liquid: adhesive
7) Coating liquid viscosity: 2000 mPa·s (value measured by a type B viscometer)
8) Separation member: included
9) Base material supporting member: not included
10) Bending member: included Fourth Example In the fourth example, a method for manufacturing a thermosensitive recording adhesive sheet using the curtain coating device 100 of the present invention will be described.

An adhesive layer was formed by applying the coating liquid 103 on a release paper using the curtain coating device 100 of the present invention. Next, a thermosensitive recording adhesive sheet was formed by adhering the release paper on which the adhesive layer was formed with a sheet on which a thermal recording layer was formed, such that the side of the sheet on which the thermal recording layer was not formed comes into contact with the adhesive layer.

An arrangement of the coating width control member 27 was adjusted so that about 5 mm of an adhesive uncoated area was formed on both end portions of the release layer of the thermosensitive recording adhesive sheet, in the width direction of the release layer. Δdave of a boundary (in other words, an end portion of an adhesive coated area) between the adhesive coated area and the uncoated area was calculated and found to be 1.14 mm. Consequently, the trimming width of the uncoated area in the thermosensitive recording adhesive sheet became the minimum of 5.57 mm, and it was possible to utilize more coating area for manufacturing the thermosensitive recording adhesive sheet.

Fifth Comparative Example

A thermosensitive recording adhesive sheet was created similarly to the fourth example except that a conventional curtain coating device that does not include the base material supporting member was used. Δdave in the thermosensitive recording adhesive sheet was 5.72 mm, and thus the trimming width of the uncoated area needed to be 7.86 mm even at minimum. Consequently, a lot of coated area needed to be cut off.

Next, the results of the first to the third examples and the first to the fourth comparative examples are summarized in table 1.

TABLE 1

| | $\Delta d_{ave}$ | Evaluation |
|---|---|---|
| First Example | 1.02 mm | A |
| Second Example | 1.14 mm | A |
| Third Example | 1.21 mm | A |
| First Comparative Example | 4.29 mm | D |
| Second Comparative Example | 5.72 mm | D |
| Third Comparative Example | 2.53 mm | C |
| Fourth Comparative Example | 3.18 mm | C |

Aspects of the present invention are as follows, for example.

First Aspect

A curtain coating device includes a curtain coating member, a conveyance unit, a separation member, and a base material supporting member. The curtain coating member creates a curtain-like film of coating liquid and makes the curtain-like film flow down. The conveyance unit conveys a base material to which the curtain-like film is to be applied. The separation member includes a receiving portion inclined downward from inside to outside in a width direction of the curtain-like film, and separates an end portion of the curtain-like film having flowed down by receiving the end portion with the receiving portion above the base material. The base material supporting member is disposed inside in the width direction of the curtain-like film than the receiving portion of the separation member, and supports the base material on an upper side flat portion while the base material is being conveyed.

Second Aspect

The curtain coating device according to the first aspect further includes a bending member. The bending member is provided on an upstream side in the base material conveying direction than the position at which the curtain-like film reaches the base material and than the separation member, and bends an end portion of the base material.

Third Aspect

In the curtain coating device according to the first or the second aspect, a minimum distance between an upper end portion of the base material supporting member and the receiving portion is within a numerical value range obtained by adding 0.1 mm to 20 mm to thickness of the base material.

Fourth Aspect

In the curtain coating device according to any one of the first to the third aspects, the receiving portion is inclined relative to the upper side flat portion at an angle from 30 degrees to 60 degrees.

Fifth Aspect

In the curtain coating device according to any one of the first to the fourth aspects, a distance between the upper side flat portion and a lower side edge of the receiving portion is equal to or less than 3 mm.

Sixth Aspect

In the curtain coating device according to any one of the first to the fifth aspects, the conveyance unit includes a first roller and a second roller. The upper side flat portion is placed at a higher position by 0 mm to 10 mm than a position of the base material, when the base material is stretched between the first roller and the second roller, while the base material supporting member is not provided.

Seventh Aspect

The curtain coating device according to any one of the first to the sixth aspects further includes a coating liquid flowing member. The coating liquid flowing member is coupled to the separation member such that a coating liquid separated by the separation member flows along. A surface of the coating liquid flowing member along which the separated coating liquid flows is formed in a shape having a curvature.

Eighth Aspect

In the curtain coating device according to any one of the second to the seventh aspects, the bending member, the separation member, and the base material supporting member are capable of moving in the width direction of the curtain-like film.

Ninth Aspect

A curtain coating method includes: creating a first curtain-like film and making the first curtain-like film flow down by a curtain coating member; separating an end portion of the first curtain-like film that has flowed down by receiving the end portion of the first curtain-like film using a receiving portion of a separation member provided on a flow passage of the first curtain-like film; and conveying a base material such that the base material passes a position where a second curtain-like film that is not separated and that flows down in a curtain shape flows. The base material passes above a base material supporting member while tension is applied to the base material by the base material supporting member. The base material is disposed inside in a width direction of the first curtain-like film than the receiving portion of the separation member provided on an upstream side in a conveying direction than a flowing down position of the second curtain-like film.

With the present invention, it is possible to advantageously obtain a curtain coating device capable of preventing the base material from flapping and keeping the uncoated width of the end portion in the base material width direction uniform. Moreover, with the present invention, by using the curtain coating device of the present invention, it is possible to advantageously reduce the cutting-off amount of the uncoated portion in the cutting-off process, utilize more coated area, and improve productivity.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

What is claimed is:

1. A curtain coating device, comprising:

a curtain coating member that creates a curtain film of a coating liquid and that makes the curtain film flow down;

a conveyer that conveys a base material to which the curtain film is to be applied;

a separator that includes a receiving portion inclined downward from inside to outside in a width direction of the curtain film, and the separator separating an end portion of the curtain film having flowed down by receiving the end portion with the receiving portion above the base material; and a base material support that is disposed below the base material and inside in the width direction of the curtain film of the receiving portion of the separator, and that supports the base material on an upper side flat portion of the base material support while the base material is being conveyed, the base material support being non-rotatable.

2. The curtain coating device according to claim 1, further comprising a bending member that is provided on an upstream side in a base material conveying direction of a position at which the curtain film reaches the base material and of the separator, and that bends an end portion of the base material.

3. The curtain coating device according to claim 2, wherein the bending member, the separator, and the base material support are capable of moving in the width direction of the curtain film.

4. The curtain coating device according to claim 1, wherein a minimum distance between an upper end portion of the base material support and the receiving portion is within a numerical value range obtained by adding 0.1 mm to 20 mm to thickness of the base material.

5. The curtain coating device according to claim 1, wherein the conveyer includes a first roller and a second roller, and the upper side flat portion is placed at a higher position by 0 mm to 10 mm than a position of the base material, when the base material is stretched between the first roller and the second roller, while the base material support is not provided.

6. The curtain coating device according to claim 1, further comprising a coating liquid flowing member that is coupled to the separator such that a coating liquid separated by the separator flows along, wherein a surface of the coating liquid flowing member along which the separated coating liquid flows is formed in a shape having a curvature.

7. The curtain coating device according to claim 1, wherein the receiving portion is inclined relative to the upper side flat portion at an angle from 30 degrees to 60 degrees.

8. The curtain coating device according to claim 1, wherein a distance between the upper side flat portion and a lower side edge of the receiving portion is equal to or less than 3 mm.

* * * * *